US005704774A

United States Patent [19]

Rha

[11] Patent Number: 5,704,774

[45] Date of Patent: Jan. 6, 1998

[54] PUMP WITH TWIN CYLINDRICAL IMPELLERS

[76] Inventor: Phil Chan Rha, 3-404 Daewoo Mokhwa Apartment 31-1 Seongjeong-dong, Chunan-shi, Choongchungnam-do 330-170, Rep. of Korea

[21] Appl. No.: 571,990

[22] PCT Filed: May 3, 1995

[86] PCT No.: PCT/KR95/00046

§ 371 Date: Jan. 3, 1996

§ 102(e) Date: Jan. 3, 1996

[87] PCT Pub. No.: WO95/31644

PCT Pub. Date: Nov. 23, 1995

[30] Foreign Application Priority Data

May 11, 1994 [KR] Rep. of Korea ..... 1994/10299

[51] Int. Cl.[6] ..... F01C 1/02

[52] U.S. Cl. ..... 418/58; 418/182; 418/209

[58] Field of Search ..... 418/58, 61.1, 64, 418/66, 153, 154, 187, 208, 209

[56] References Cited

U.S. PATENT DOCUMENTS

| | | | |
|---|---|---|---|
| 720,542 | 2/1903 | Wharton | 418/58 |
| 1,041,606 | 10/1912 | Dembrowsky | 418/58 |
| 2,103,474 | 12/1937 | Lindberg | 418/58 |
| 2,606,498 | 8/1952 | Witherell | 418/58 |
| 3,567,349 | 3/1971 | Meulendyk | 418/61.1 |
| 4,371,323 | 2/1983 | Fischer et al. | 418/182 |

*Primary Examiner*—Charles G. Freay

*Attorney, Agent, or Firm*—Watson Cole Stevens Davis, P.L.L.C.

[57] ABSTRACT

A pump which is easy to manufacture and which has a high efficiency and low vibration includes a pair of identical circular-shaped impellers which are respectively eccentrically and rotatably connected to respective parallel shafts so as to rotate oppositely to one another while keeping a constant spacing therebetween, a pair of identical cylindrical impeller chambers in which the impellers are respectively positioned such that the impellers circumferentially slide along an inner peripheral surface of the impeller chambers, one impeller acting to discharge fluid from the impeller chamber in which it rotates and the other acting to intake fluid into the impeller chamber in which it rotates, and a connecting plate that couples the impellers together and causes them to be spaced a constant distance apart.

3 Claims, 7 Drawing Sheets

PUMP WITH TWIN CYLINDRICAL IMPELLERS

BACKGROUND OF THE INVENTION

1. Field of the Invention

The present invention relates to a pump, and more particularly to a pump which includes a pair of cylindrical impellers respectively adapted to revolve about a pair of shafts in opposite directions at the same eccentricity with respect to the associated shafts while keeping a constant distance therebetween, thereby obtaining a silent and strong fluid pumping function with a high efficiency.

2. Description of the Prior Art

Generally, conventional pumps achieve a fluid pumping function by rotating blade type, gear type, scroll type or cam type impellers about a fixed axis in a pump body. However, such conventional pumps have a disadvantage of a large consumption of force because of a large movement length of the impeller per suction/delivery stroke, a very large area of impeller in contact with a fluid being discharged, and an intense turbulent contact condition between the impeller and the fluid. Furthermore, the pumps generate a large amount of frictional heat and an abrasion phenomenon. Consequently, they have difficulty achieving a high speed operation and they have a short life span. Since these conventional pumps have a complex impeller construction and a complex impeller chamber construction, they have a limitation on design and application. For example, the pump of the blade type is very difficult and expensive to manufacture its impeller. In particular, the pump of this type is inefficient in pumping out of human waste, waste water including a variety of foreign matters or other fluid including other solid matters because the matters included in the fluid interfere with blades of the impeller, and thereby disturb the pumping action of the impeller. In addition, this pump has an improper construction for discharge of a chemical liquid which should not be exposed to a turbulent flow and to application for a vacuum pump.

In the case of a pump of the type including a cylindrical pump body having check valve means and a piston adapted to reciprocate linearly in the pump body, a low pump efficiency is obtained since it involves a pulsative pumping action which is disadvantageous to the pump efficiency and has a relatively high proportion of ineffective volume between the cylinder head and the piston, which does not contribute to the suction and delivery of fluid. Since the stroke of the piston is relatively long, this pump also has a drawback that it is unreasonably large in size for its pumping capacity.

Korean Paten Publication No. 91-4769 (corresponding to Japanese Patent Application No. Sho 63-126511) discloses a rotary type compressor which operates in a manner similar to that of the pump according to the present invention. This compressor includes a cylinder, a circular rotor arranged in the cylinder to perform an eccentric rotation in a circumferential direction along the inner surface of the cylinder, and a movable blade member adapted to divide the fluid chamber defined between the cylinder and the rotor into a suction-side low pressure space and a delivery-side high pressure space. However, this construction involves a long stroke of the rotor for carrying out one complete pumping cycle because its pumping action is obtained by the eccentric rotation of only one single circular rotor. As a result, a low pump efficiency is obtained. Furthermore, this compressor has a complex construction including a number of weakened parts mainly due to its relatively thin movable blade member for dividing the fluid chamber defined between the rotor and the cylinder into the low pressure-side space and the high pressure-side space and valve means for preventing a reverse flow of fluid from a discharge port during the suction stroke of the rotor. As a result, the compressor involves drawbacks of difficulty in achieving a trouble-free operation under a high pressure and at a high speed, and it has a short life span.

There has also been proposed a vane pump of the type including an eccentrically rotating circular member, a plurality of plate-shaped vanes mounted on the rotating member such that they are able to radially move in and move out the member, and a cylindrical pump housing in which the rotating member slides along the inner side of the housing. Such a vane pump is disclosed in Korean Patent Publication No. 90-3682 (corresponding to Japanese Utility Model Application No. Sho 61-178289). However, this pump has drawbacks similar to those of the above-mentioned compressor because its pumping operation is achieved only by one single eccentrically rotating member and it involves a pump construction having a number of plate-shaped vanes mounted to move in and move out the rotating member during its pumping operation.

There has also been proposed a pump of the type including a fixed scroll formed in a spiral shape and a movable scroll formed in a spiral shape similar to that of the fixed scroll, both scrolls cooperating with each other to achieve the intended pumping action for a fluid such as a refrigerant. Such a scroll type pump is disclosed for example in Korean Patent Publication No. 89-628 (corresponding to Japanese Patent Application No. Sho 59-222753 and Japanese Patent Application No. Sho 59-168236). However, this pump has a complex construction causing difficulty in manufacture and it is an expensive to manufacture because its scroll members for carrying out its pumping operation have a complicated spiral construction to be formed with complex involute and circular curvatures. Furthermore, the suction/delivery amount per one pumping cycle of the movable scroll is relatively small because the suction and delivery of the fluid is carried out through a long narrow fluid chamber defined between the movable scroll and the fixed scroll during its pumping operation. As a result, this pump is not usable for pumping a fluid including foreign matter, or a thickened fluid, or for pumping the other general fluid in a large amount.

SUMMARY OF THE INVENTION

Therefore, the object of the present invention is to solve the above-mentioned problems and drawbacks of conventional pumps and, thus, to provide a pump of a simple and efficient construction capable of achieving an easy manufacture, a high pump efficiency and a variety of applications.

In accordance with the present invention, this object is accomplished by providing a pump including: a pair of identical cylindrical impellers adapted to respectively revolve about their axes in opposite directions at the same eccentricity with respect to the associated axes while keeping a constant distance therebetween; a pair of identical cylindrical impeller chambers adapted to respectively receive the impellers such that the impellers slide along each of the inner surfaces of the impeller chambers; and a connecting plate adapted to couple the impellers to each other. Due to the simple, completely circular shaped impellers and impeller chambers of the pump, the present pump scarcely shows weakening of parts resulting from the movable pump elements as usually shown in the conventional pumps. Further, the present pump provides a great easiness in manufacturing and a long pump life. Since the impellers having the completely circular shapes alternatively and substantially carry out each pumping cycle with each half revolving of the impellers around their axes, and with smoothly sliding along each of the inner surfaces of the impeller chambers, the pump achieves a pumping operation almost free of any undesirable pulsative action, noise and vibration. It is also possible to achieve an efficient and silent pumping operation without waste of force by virtue of a short stroke of the impellers during one pump cycle, a minimized contact area between the impellers and the fluid being pumped, and no generation of any vortical or turbulent flow. In particular, it does not fail even in an operation at a high speed and under a high pumping pressure.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1D:
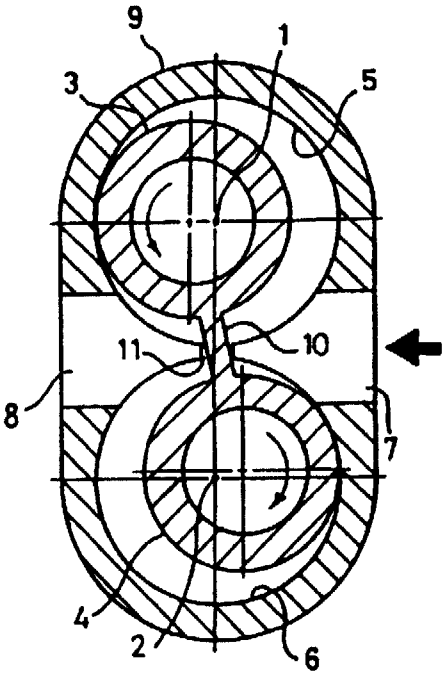
FIGS. 1A to 1D are sectional views illustrating a basic construction of the pump in accordance with the present invention and its operation.

FIGS. 1A to 1D are sectional views for explaining the basic concept of construction and operation of the pump in accordance with the present invention.

As shown in FIGS. 1A to 1D, the pump of the present invention includes a first impeller 3 having a perfectly circular shaped (or cylindrically shaped) body. The first impeller 3 revolves about an axis 1 in a predetermined direction at a given eccentricity with respect to the axis 1. The pump also includes a second impeller 4 having the same construction as the first impeller 3, namely, having a perfectly circular shaped body. The second impeller 4 revolves about another axis 2 arranged near the axis 1 in parallel to the axis 1 in a direction opposite to the revolution direction of the first impeller 3 with the same eccentricity to the axis 2, as that of the first impeller 3 to the axis 1. The pump also includes a pair of impeller chambers, the first one being indicated by the reference symbol 5 while the second one being indicated by the reference symbol 6. In the first impeller chamber 5, the first impeller 3 slides circumferentially in a determined manner. In the second impeller chamber 6, the second impeller 4 slides circumferentially also in a determined manner. Although the axes 1 and 2, which are revolution centers of the impellers 3 and 4 respectively, are shown in the form of points for the convenience of illustration, they are in fact the shafts respectively positioned at the centers of the corresponding impeller chambers 5 and 6. One of those shafts may be a drive shaft which is rotated in a predetermined direction by an external drive source such as an electric motor while the other being a driven shaft which is rotated in a direction opposite to that of the drive shaft by the rotational force of the drive shaft.

The first and second impellers 3 and 4 are arranged in the impeller chambers 5 and 6 respectively such that they revolve in opposite directions about the axes 1 and 2, namely, the revolution centers thereof under a condition that they are equidistantly maintained. The first and second impeller chambers 5 and 6, in which the first and second impellers 3 and 4 circumferentially slide in a determined manner, communicate in common with a suction port 7 at one side of their portions adjacent to each other. The first and second impeller chambers 5 and 6 also communicate in common with a discharge port 8 at the other side of their adjacent portions. The first and second impeller chambers 5 and 6, suction port 7 and discharge port 8 may be provided by a single casing 9, as in the illustrated case.

Figure 1C:
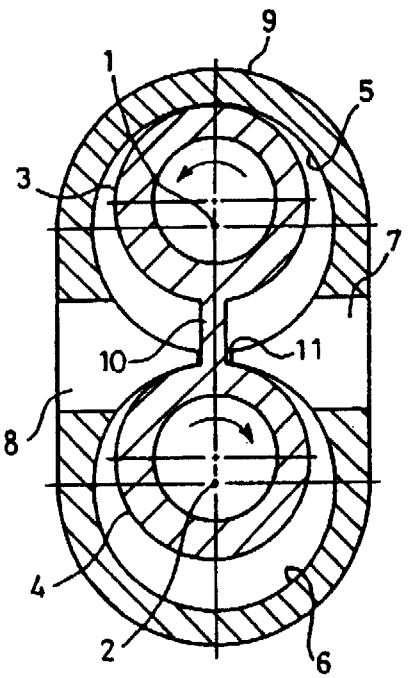
Figure 1B:
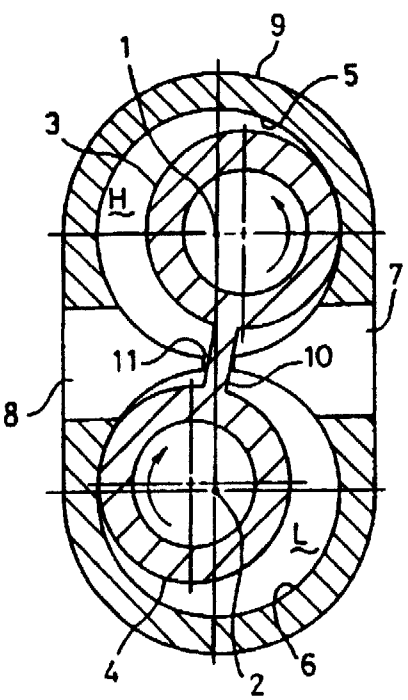

A connecting plate 10 is arranged between the first and second impellers 3 and 4. The connecting plate 10 extends through a slit 11 formed at the most adjacent portions of the first and second impeller chambers 5 and 6. The connecting plate 10 is connected at one end thereof to the first impeller 3 and at the other end thereof to the second impeller 4. Together with the first and second impellers 3 and 4, the plate 10 serves to divide the fluid chamber defined in the casing 9 into a high pressure-side space H and a low pressure-side space L during operation of the pump, for example as shown in FIG. 1B. The fluid chamber of the casing 9 is defined by the first and second impeller chambers 5 and 6, suction port 7, discharge port 8 and slit 11.

Figure 1A:
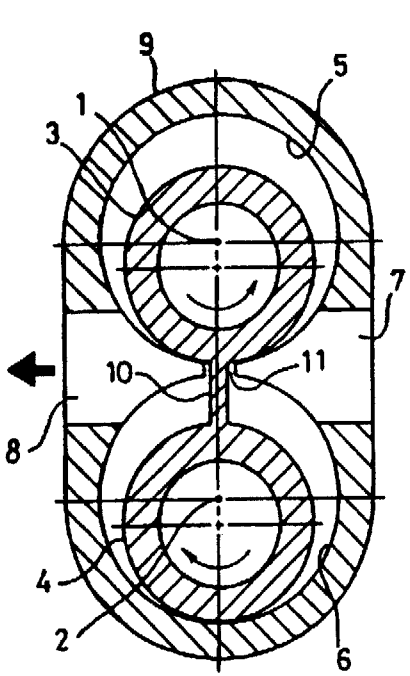

FIG. 1A shows an initial state of the pump that the first and second impellers 3 and 4 are positioned at their bottom dead points in the casing 9 and vertically aligned with each other. As the first and second impellers 3 and 4 begin to revolve about their revolution axes 1 and 2 in opposite directions respectively from the initial state, the impellers 3 and 4 and the plate 10 act repeatedly a series of movements obtaining sequential states shown in FIG. 1B, FIG. 1C and FIG. 1D and returning to the state shown in FIG. 1A during the pumping operation. FIG. 1B shows the state that one of the impellers, for example, the impeller 3 has revolved about its revolution axis 1 through an angle of 90° in a direction indicated by the arrow of FIG. 1B from the state of FIG. 1A. FIG. 1C shows the state that the impeller 3 has revolved again through an angle of 90° in the same direction as that of FIG. 1B from the state of FIG. 1B. FIG. 1D shows the state that the impeller 3 has revolved again through an angle of 90° in the same direction as that of FIG. 1C from the state of FIG. 1C. In other words, the movable elements of the pump including the first and second impellers 3 and 4 and the plate 10 connecting the impellers 3 and 4 obtain the sequential and continued states of FIG. 1A, FIG. 1B, FIG. 1C and FIG. 1D, in this order, during each of the impellers 3 and 4 carries out its one complete revolution. During this operation, the first and second impellers 3 and 4 slide circumferentially in a determined manner along the inner cylindrical surfaces of the first and second impeller chambers 5 and 6 such that their outer cylindrical surfaces are in close contact with the inner surfaces of the impeller chambers 5 and 6, respectively.

Where all the first and second impellers 3 and 4 and the plate 10 connecting the impellers are regarded as constituting a single, integrated movable body, the internal space of the casing 9 is divided into a high pressure-side space (for example, the space H) communicated to the side of the discharge port 8 and a low pressure-side space (for example, the space L) communicated to the side of the suction port 7 so that suction and delivery actions for a fluid are generated in the spaces during the above-mentioned operation. For instance, as the first impeller 3 slides along the inner surface of the first impeller chamber 5, for example, from the state of FIG. 1B to the state of FIG. 1D via the state of FIG. 1C, a space defined in the first impeller chamber 5 at the left side of the first impeller 3 and the plate 10 is gradually reduced in volume, thereby causing a fluid contained in the space to be discharged under pressure toward the discharge port 8. At the same time, a space defined in the first impeller chamber 5 at the right side of the first impeller 3 and the plate 10 is gradually increased in volume so that its internal pressure is lowered. As a result, a vacuum is generated in the right space of the first impeller chamber 5, thereby generating a suction force for a fluid. Following the above-mentioned movement of the first impeller 3, the second impeller 4 slides along the inner surface of the second impeller chamber 6, for example, from the state of FIG. 1D to the state of FIG. 1C via the state of FIG. 1A, a space defined in the second impeller chamber 6 at the left side of the second impeller 4 and the plate 10 is gradually reduced in volume, thereby causing a fluid contained in the space to be discharged under pressure toward the discharge port 8. At the same time, a space defined in the second impeller chamber 6 at the right side of the second impeller 4 and the plate 10 is gradually increased in volume so that its internal pressure is lowered. As a result, a vacuum is generated in the right space of the second impeller chamber 6, thereby generating a suction force for a fluid. Thus, the pump can deliver the fluid in a substantially continued manner as the fluid sucking and discharging operations of the first and second impellers 3 and 4 are alternatingly carried out in a repeatedly continued manner.

It should be particularly noted that during the operation of the pump, one of the impellers 3 and 4, for example the impeller 3, begins to carry out its fluid sucking and discharging operation just after the other impeller, for example, the impeller 4 completes its fluid sucking and discharging stroke as it revolves about its axis 2 through an angle of 180°. Where the axis 1 is a drive shaft, one complete fluid sucking and discharging action is achieved for every half (½) revolution of the drive shaft. Accordingly, the pump of the present invention can provide the same fluid delivery as the conventional pumps having a single cylindrical revolution construction (Korean Patent Publication No. 91-4769) adapted to obtain one complete fluid sucking and discharging action for every one revolution of the drive shaft, by using a pump speed and a drive energy both being substantially half those used in the conventional pumps. In other words, the pump of the present invention obtains a fluid delivery corresponding to twice that obtained in the conventional pumps under the same pump speed and pump capacity. Although the fluid sucking and discharging operations of the impellers 3 and 4 has been described as being carried out at particular movement positions, they are actually generated at almost all positions of the impellers 3 and 4 in a symmetrically complemented and continued manner. In terms of the fluid sucking and discharging function, therefore, the pump of the present invention provides a pumping operation with a high pump efficiency not expected in conventional pumps and almost free of any pulsation phenomenon, noise and vibration, by virtue of the harmonious pumping actions of the impellers 3 and 4 having the symmetrically complementing relation. Moreover, the pumping operation of the pump in accordance with the present invention is very silent and strong because the impellers 3 and 4 slide smoothly and silently along each of the inner surfaces of the impeller chambers 5 and 6 while being in close contact with the inner surfaces. Accordingly, there is no overwork even in an operation at a high speed and under high pressure. Since the abrasion and damage rate of mechanisms used for the pump are minimized, a long pump life span is obtained. In addition, the pump has simple constructions of the impellers 3 and 4 and impeller chambers 5 and 6, and it can meet freely a variety of required pump capacities.

Figure 2:
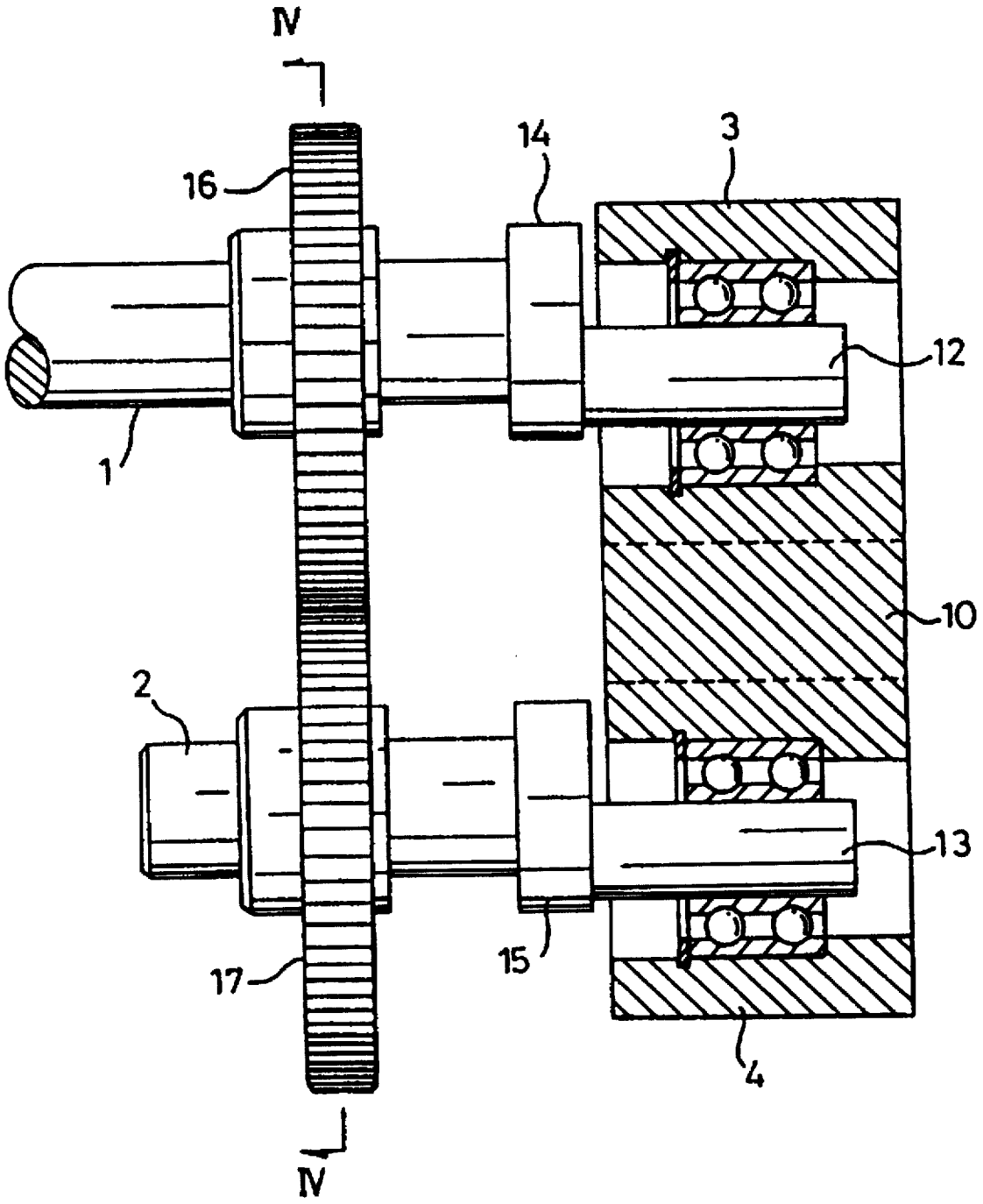
FIG. 2 is a partial sectional view illustrating a preferred embodiment of the impellers for the pump shown in FIG. 1.

In accordance with a preferred embodiment of the present invention, the eccentric revolutions of the impellers 3 and 4 about respective axes 1 and 2 are obtained through an arrangement shown in FIG. 2. In the arrangement of FIG. 2, discs 14 and 15 respectively having eccentric shafts 12 and 13 are coupled to respective one ends of the revolution axes 1 and 2 taken in the form of shafts. On respective free ends of the eccentric shafts 12 and 13, the impellers 3 and 4 are rotatably mounted. The connecting plate 10 is fixedly coupled at its both ends to respective corresponding portions of the impellers 3 and 4. The shafts 1 and 2 are operatively connected by means of transmission gears 16 and 17 such that they rotate in opposite directions. The coupling of the plate 10 may be achieved by forming the plate 10 to be integral with the impellers 3 and 4 or welding a separate connecting plate to the impellers 3 and 4. By virtue of such a firm coupling of the connecting plate 10 to the impellers 3 and 4, the plate 10 can move integrally with the impellers 3 and 4, so that no abrasion nor damage may occur at the coupling areas of the plate 10. As a result, it is possible to obtain an advantage of providing a pump with a film and durable construction almost free of weak portions.

As the shafts 1 and 2 revolve in this embodiment, the impellers 3 and 4 eccentrically coupled to the shafts 1 and 2 are revolved about the shafts 1 and 2 in opposite directions while keeping an equal distance therebetween. If the rotation angular velocities of the shafts 1 and 2 and thus the revolution angular velocities of the impellers 3 and 4 revolving about the shafts 1 and 2 are set to be identical to each other, the distance between the centers of impellers 3 and 4 at the state of FIG. 3B obtained after the impellers 3 and 4 revolve 90° in opposite directions indicated by the arrows in FIG. 3A from the initial state of FIG. 3A becomes larger than that at the state of FIG. 3A. As a result, an overwork in operation of the mechanisms may occur.

Figure 3A:
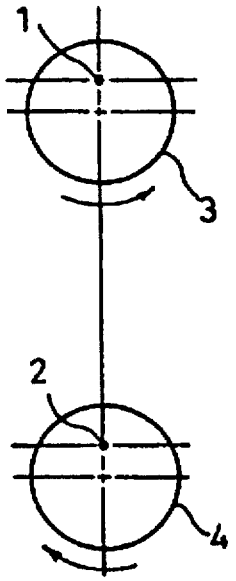
FIGS. 3A and 3B are schematic views for explaining the operational relationship of the two impellers in case that the rotation angular velocities of the impeller shafts and the revolution angular velocities of the impellers revolving around the impeller shafts are set to be identical with each other.
Figure 3B:
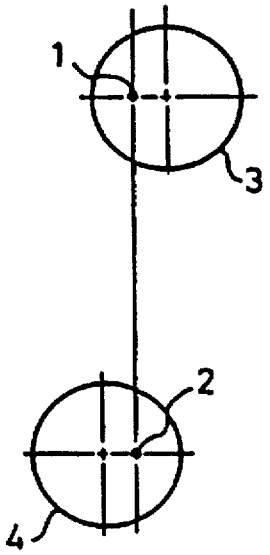
Figure 4:
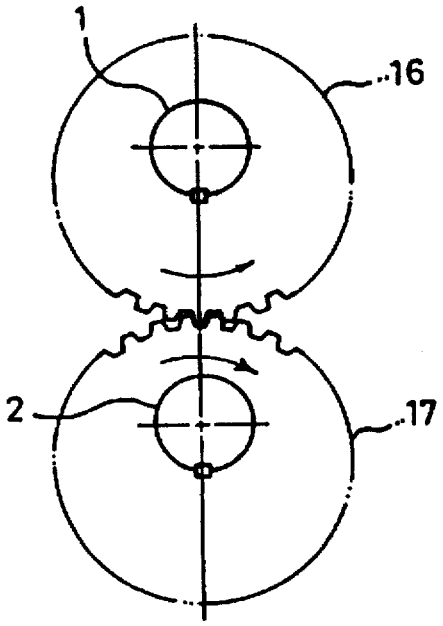
FIG. 4 is a schematic cross-sectional view taken along the line IV—IV of FIG. 2.

In order to enable the opposite revolutions of impellers 3 and 4 under a condition that the distance between the impellers 3 and 4 are kept constant, the revolution angular velocities of the impellers 3 and 4 should be different from each other in a fashion that when the impeller 3 reaches the state of FIG. 3B after being revolved through an angle of 90° in a direction indicated by the arrow in FIG. 3A from the state of FIG. 3A, the impeller 4 reaches a state that it has been revolved through an angle slightly larger than 90° in a direction opposite to that of the impeller 3. To this end, the impellers 3 and 4 are coupled to each other by a transmission gear unit including a pair of identical transmission gears 16 and 17 engaged with each other and respectively coupled to the shafts 1 and 2 in an eccentric manner, as shown in FIG. 4 which is a cross-sectional view taken along the line IV—IV of FIG. 2. As the gear 16 mounted on the shaft 1 rotates 90° from the state of FIG. 4 by a rotation of the shaft 1 in this construction, the gear 17 engaged at its small diameter portion with the large diameter portion of the gear 16 and thus the shaft 2 firmly supporting the gear 17 rotate through an angle larger than 90° in a direction indicated by an arrow in FIG. 4. By such an operation, the impellers 3 and 4 respectively revolving about the shafts 1 and 2 are different in revolution angular velocity from each other so that their opposite revolutions about the shafts 1 and 2 can be made under a condition that the distance between the impellers 3 and 4 is kept constant.

Figure 5A:
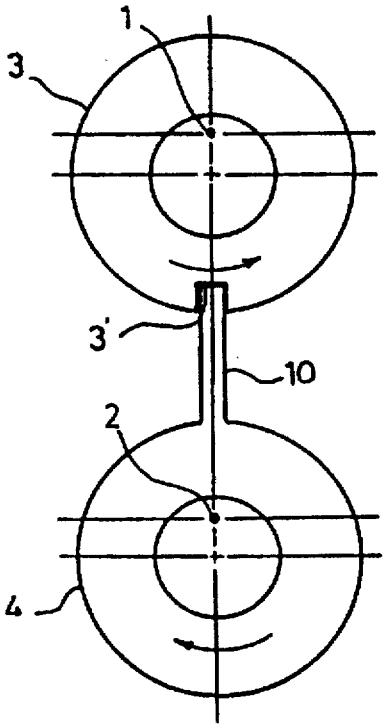
FIGS. 5A and 5B are schematic views illustrating a preferred embodiment of the connecting plate between the two impellers in case that the rotation angular velocities of the impeller shafts and the revolution angular velocities of the impellers revolving around the impeller shafts are set to be identical with each other.
Figure 5B:
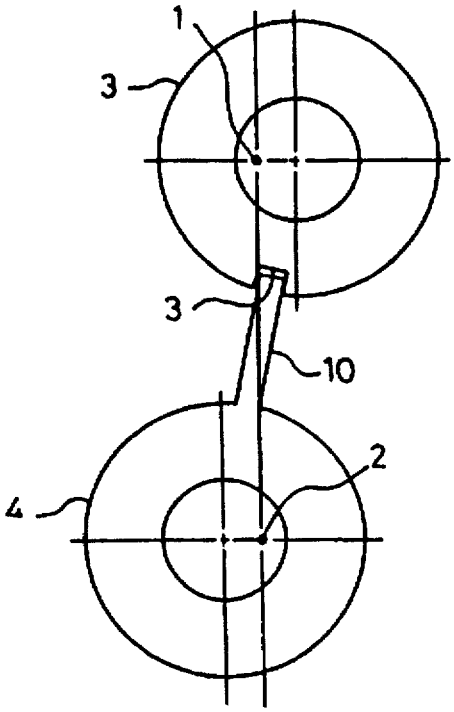

In accordance with another embodiment of the present invention, the shafts 1 and 2 for the impellers are coupled to each other by a transmission gear unit including a pair of identical transmission gears engaged with each other and respectively coupled to the shafts 1 and 2 in a concentric manner. In this case, the distance between the centers of impellers 3 and 4 is varied in a fashion described in conjunction with FIG. 3 during the above-mentioned operations of impellers 3 and 4 because the rotation angular velocities of the shafts 1 and 2 and thus the revolution angular velocities of the impellers 3 and 4 eccentrically mounted on the shafts 1 and 2 at the same eccentricity are set to be identical to each other. In this construction, therefore, an overwork in operation of the mechanisms may occur if the impellers 3 and 4 are fixedly coupled to each other by means of the plate 10. In order to eliminate such a problem, it is required to absorb the variation in the distance between the centers of impellers 3 and 4 by using absorption means. This absorption means may comprise a slide slot 3' formed at a portion of one of the impellers 3 and 4, for example, the impeller 3 to be coupled to the plate 10 separated from the impeller 3, as shown in FIG. 5. In the slide slot 3', an end of the plate 10 to be coupled to the impeller 3 is received such that it can slide radially of the impeller 3 along the slide slot 3'. Since the impeller 3 and the plate 10 are separated from each other such that they slide with respect to each other in this construction, the probability of an occurrence of abrasion and damage of mechanisms at the slide areas of the impeller 3 and the plate 10 becomes higher. In this case, however, there is an advantage of an easier pump manufacture because the transmission gears for coupling the shafts 1 and 2 to each other are constructed in the form of concentric gears having a simply circular shape, other than eccentric gears.

Figure 6A:
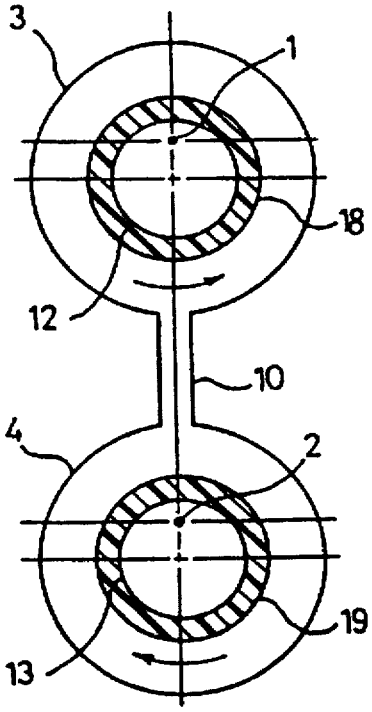
FIGS. 6A and 6B are schematic views similar to those of FIGS. 5A and 5B, but showing another possible embodiment thereof.
Figure 6B:
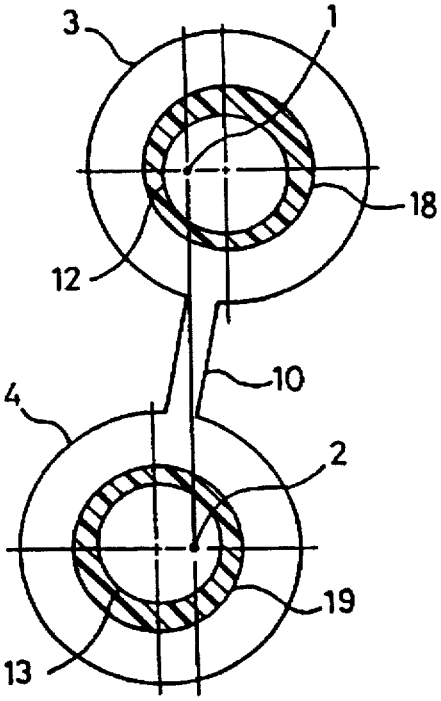

FIGS. 6A and 6B illustrate a modification from the construction of FIG. 5 in accordance with another possible embodiment of the present invention. In accordance with this embodiment, the plate 10 is fixedly coupled to both the impellers 3 and 4 without being slidably coupled at its one end to a corresponding one of the impellers 3 and 4 as in the case of FIG. 5. In this case, a pair of elastic members 18 and 19 are interposed between the impeller 3 and an eccentric shaft 12 supporting the impeller 3 and between the impeller 4 and an eccentric shaft 12 supporting the impeller 4, respectively, so as to absorb a variation in the distance between the centers of impellers 3 and 4. Only one of the elastic members 18 and 19 may be installed.

Figure 7:
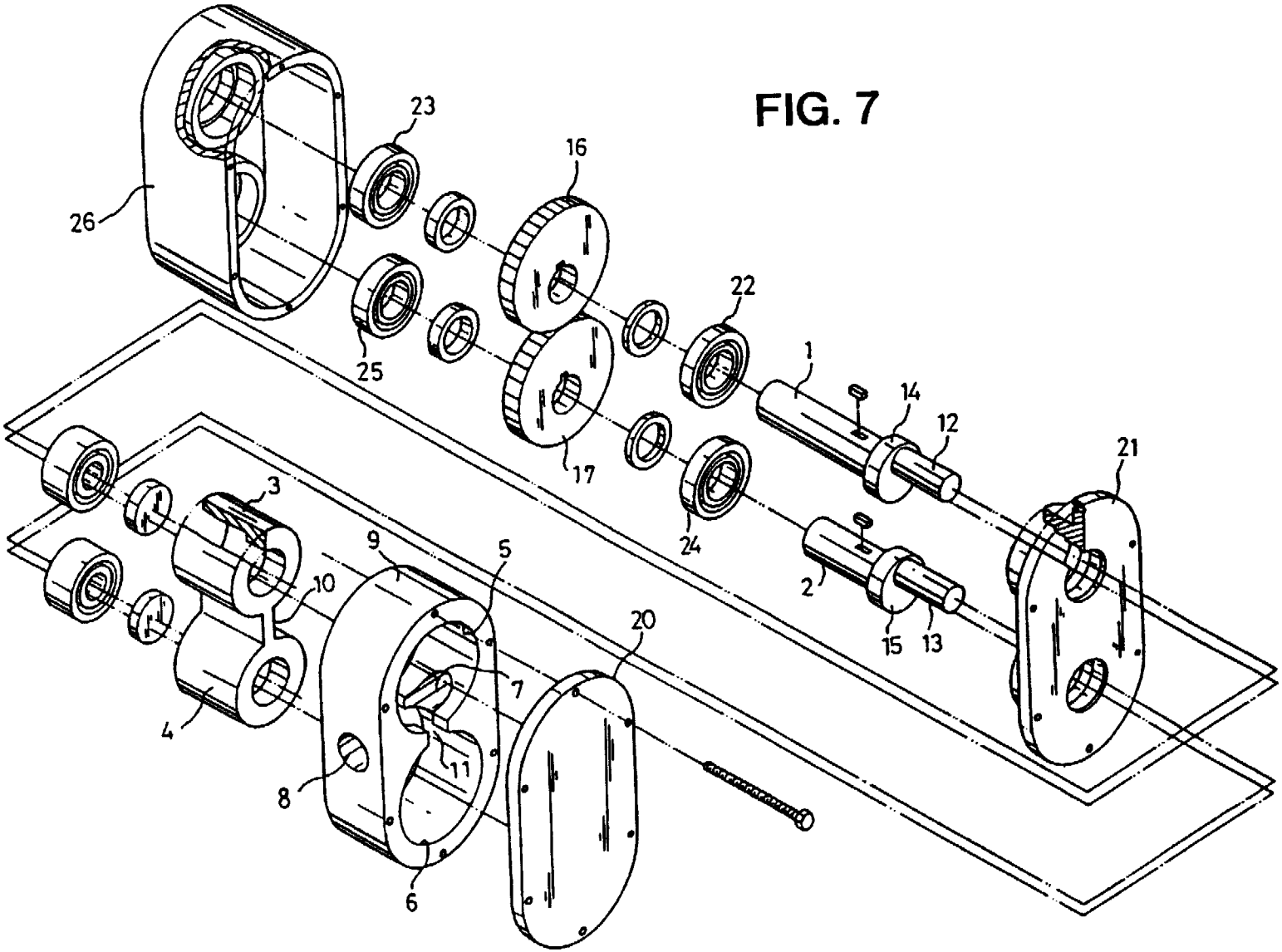
FIG. 7 is an exploded perspective view of a pump constructed in accordance with the embodiment illustrated in FIGS. 1, 2 and 4.
Figure 8:
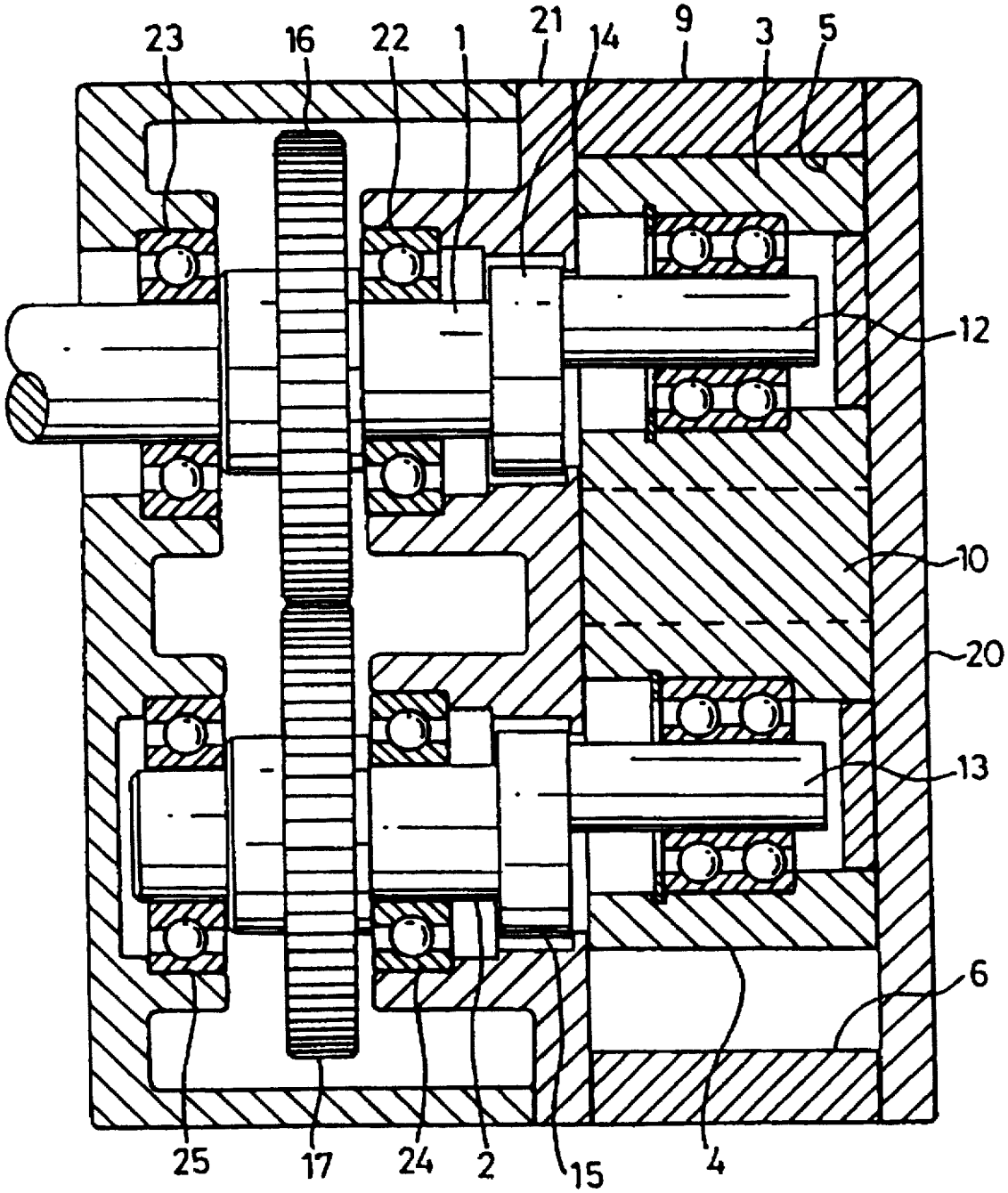
FIG. 8 is a sectional view of the pump shown in FIG. 7 in its assembled state.

A complete pump construction in accordance with any one of the embodiments illustrated in FIGS. 1, 2 and 4 are shown in FIG. 7 which is an exploded perspective view and FIG. 8 which is a sectional view corresponding to FIG. 7. This construction includes a pair of impeller shafts 1 and 2. The shaft 1 functions as a drive shaft being rotated by an external drive source while the shaft 2 functions as a driven shaft being rotated by a rotation force of the drive shaft 1 transmitted via the transmission gears 16 and 17. A pair of impellers 3 and 4 are eccentrically mounted on the shafts 1 and 2 at the same eccentricity. The impellers 3 and 4 are coupled to the plate 10 so that they are integral with each other, thereby enabling them to carry out the revolutions as mentioned above while maintaining a constant distance therebetween. Transmission gears 16 and 17 adapted to couple the shafts 1 and 2 to each other have the form of eccentric gears enabling the impellers 3 and 4 to revolve in opposite directions while maintaining a constant distance therebetween as mentioned above. An end plate 20 and an intermediate plate 21 are coupled to both lateral ends of the casing 9, respectively. Between the end plate 20 and intermediate plate 21, a pair of sealed impeller chambers 5 and 6 are defined in the casing 9. In the impeller chambers 5 and 6, the impellers 3 and 4 are revolved, respectively. The intermediate plate 21 also serves to rotatably support the shafts 1 and 2 by means of bearings 22, 23, 24 and 25. To the side of intermediate plate 21 opposite to the casing 9, an appropriate cover construction 26 is fixedly mounted which serves to cover the shafts 1 and 2 and their transmission gears 16 and 17 in order to protect them. Preferably, the impellers 3 and 4 are journalled to eccentric shafts 12 and 13, respectively.

The pump shown in FIG. 5 or FIG. 6 has the same construction as that shown in FIGS. 7 and 8 except that mounting constructions of the impellers 3 and 4 and transmission gears 16 and 17 are slightly different from those of FIGS. 7 and 8.

Figure 9:
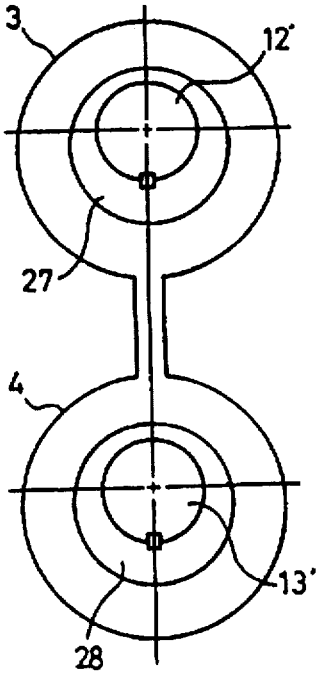
FIG. 9 is a schematic sectional view illustrating another possible embodiment for eccentrically revolving the impellers around their impeller shafts.

FIG. 9 illustrates another possible embodiment for eccentrically revolving the impellers 3 and 4 around their shafts 1 and 2. In place of using the eccentric shafts 12 and 13 respectively provided at ends of the shafts 1 and 2 and adapted to support the impellers 3 and 4 as in the above-mentioned cases, this construction uses a pair of eccentric rings 27 and 28 respectively fitted around concentric extensions 12' and 13' formed at ends of the shafts 1 and 2. Around the eccentric rings 27 and 28, the impellers 3 and 4 are fitted, respectively.

Figure 10:
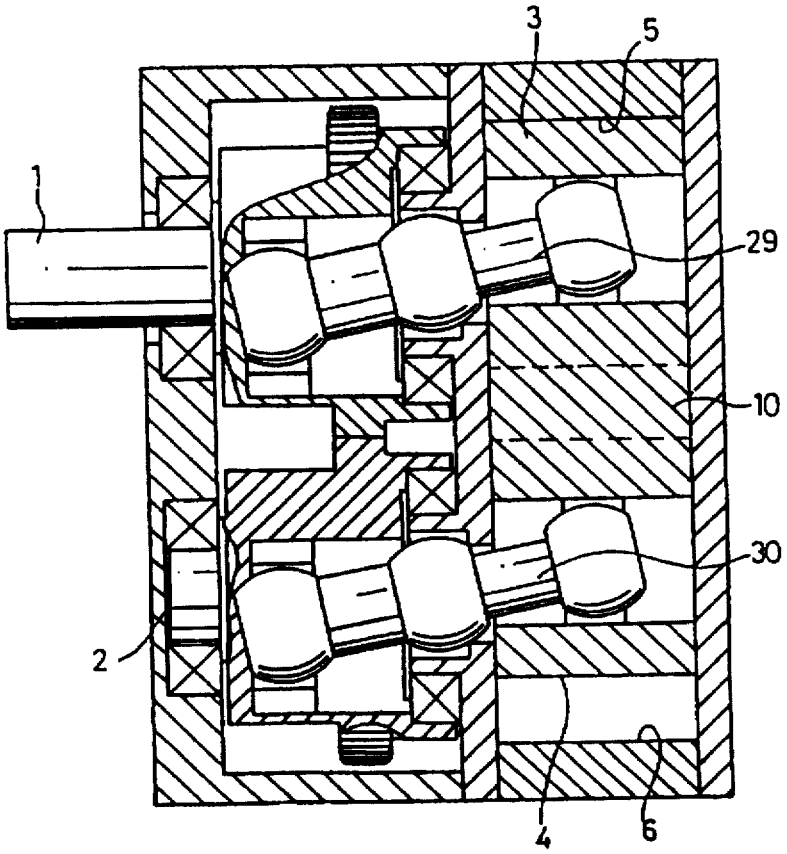
FIG. 10 is a schematic sectional view illustrating another possible embodiment for eccentrically revolving the impellers around their impeller shafts.

FIG. 10 illustrates another possible embodiment for eccentrically revolving the impellers 3 and 4 around their shafts 1 and 2 in accordance with another embodiment of the present invention. In accordance with this embodiment of the present invention, a pair of pivot levers 29 and 30 are connected between the shaft 1 and the impeller 3 and between the shaft 2 and the impeller 4, respectively.

Figure 11:
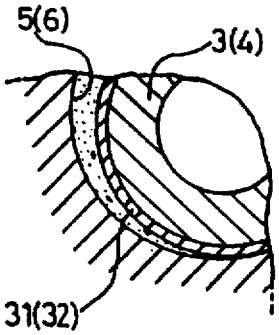
FIG. 11 is a partial sectional view illustrating another embodiment of the present invention comprising the coatings formed on the outer surfaces of the impellers.

In all the above-mentioned embodiments of the present invention, the impellers 3 and 4 may be coated at their outer surfaces respectively with coatings 31 and 32 made of a material exhibiting an elasticity and a durability such as a rubber, as shown in FIG. 11. In this case, the coatings 31 and 32 serve to enhance the sealing effect generated between each of the impellers 3 and 4 and each corresponding one of the impeller chambers 5 and 6 and thereby obtain an effect capable of pumping a fluid including solid matters without any interference.

Where the revolution directions of the impellers 3 and 4 revolving about their shafts 1 and 2 are set to be opposite to those mentioned above in all the above-mentioned embodiments of the present invention, the suction port 7 serves as a discharge port while the discharge port 8 serves as a suction port. In this regard, the pump constructed in accordance with the present invention may be regarded as a bidirectional pump having no limitation on the fluid sucking and discharging directions, as different from the conventional pumps. Such a feature of the pump of the present invention is resulted from the characteristic construction and function of the impellers 3 and 4 taking the form of twin cylindrical shapes having the symmetrically complementing movement relation.

Although the preferred embodiments of the invention have been disclosed for by way of example, those skilled in the art will appreciate that various modifications, additions and substitutions are possible, without departing from the scope and spirit of the invention as disclosed in the accompanying claims.

What is claimed is:

1. A pump comprising means forming a pair of cylindrical impeller chambers which each defines an inner wall surface, said impeller chambers being separated by a slit;

a pair of identical circular-shaped impellers respectively positioned in said impeller chambers and rotatably mounted on separate shafts, said shafts being correspondingly eccentrically connected to said impellers to enable said impellers to remain at a constant distance from each other as they rotate in opposite directions around their respective shafts, said impellers circumferentially sliding along the inner surface of the impeller chamber in which they are positioned;

a connecting plate coupling the impellers to one another for maintaining a constant distance between said impellers, said connecting plate extending through said slit;

means forming a suction port and discharge port on opposite sides of adjacent portions of said impeller chambers; and identical interengaged eccentric gears connected to said shafts.

2. A pump in accordance with claim 1, further comprising a pair of discs fixed to respective ends of the shafts, each of the discs having an eccentric shaft adapted to support a corresponding one of the impellers.

3. A pump in accordance with claim, further comprising a pair of pivot levers each provided between each of the shafts and each corresponding one of the impellers and adapted to enable each impeller to revolve about each corresponding shaft by a rotation force of the shaft.

* * * * *